US006267560B1

(12) United States Patent
Charron

(10) Patent No.: US 6,267,560 B1
(45) Date of Patent: Jul. 31, 2001

(54) WET GAS COMPRESSION METHOD WITH EVAPORATION OF THE LIQUID

(75) Inventor: Yves Charron, Longpont sur Orge (FR)

(73) Assignee: Institut Francais du Petrole, Rueil-Malmaison Cedex (FR)

( * ) Notice: Subject to any disclaimer, the term of this patent is extended or adjusted under 35 U.S.C. 154(b) by 0 days.

(21) Appl. No.: 09/624,892

(22) Filed: Jul. 24, 2000

Related U.S. Application Data

(62) Division of application No. 09/238,636, filed on Jan. 28, 1999.

(30) Foreign Application Priority Data

Jan. 28, 1998 (FR) ..... 98-00930

(51) Int. Cl.[7] ..... F04B 19/24
(52) U.S. Cl. ..... 417/53; 95/190
(58) Field of Search ..... 417/53, 313, 244; 34/80, 78, 77, 380, 418; 95/190; 62/612

(56) References Cited

U.S. PATENT DOCUMENTS 3,929,438 * 12/1975 Harper et al. ..... 62/612
4,270,884 6/1981 Lintonbon .
4,437,813 3/1984 Ingram .
4,518,330 5/1985 Asami .
4,775,395 * 10/1988 Rojey et al. ..... 95/190
5,863,186 1/1999 Green .
5,961,302 10/1999 Blumenau .

FOREIGN PATENT DOCUMENTS 98303 3/1923 (CH) .
410262 10/1966 (CH) .
8703051 5/1987 (WO) .

* cited by examiner

*Primary Examiner*—Teresa Walberg
*Assistant Examiner*—Leonid Fastovsky
(74) *Attorney, Agent, or Firm*—Antonelli, Terry, Stout & Kraus, LLP

(57) ABSTRACT

A wet gas compression device combining the following stages: a separation stage providing a gas phase and a liquid phase; a conversion stage for converting a gas phrase and a liquid phase; a conversion stage for converting the liquid phase provided by the separation stage to a vapor phase by heat exchange; a compression stage for compressing the gases from the separation stage and the conversion stage and for providing a portion of gas for use in the heat exchange of the compression stage.

6 Claims, 4 Drawing Sheets

WET GAS COMPRESSION METHOD WITH EVAPORATION OF THE LIQUID

This is a divisional application of U.S. Ser. No. 09/238,636, filed Jan. 28, 1999.

FIELD OF THE INVENTION

The invention relates to a wet gas compression device comprising a gas compressor associated with a separator and with a heat exchanger upstream from the compressor.

In the present application, what is understood to be a wet gas is a mainly gaseous fluid comprising a liquid phase in such a proportion that it can be evaporated using the enthalpy increase resulting from gas compression.

BACKGROUND OF THE INVENTION

Various multiphase pump types allow compression of a two-phase mixture. However, rotodynamic type machines are limited to GLR ratios hardly greater than 20 and positive-displacement machines are relatively bulky for compression of a wet gas.

It is difficult to use conventional centrifugal or axial gas compressors to compress a gaseous fluid comprising a liquid phase because of the erosion due to the liquid droplets on the blades of the impellers, of the embrittlement of the blades and of the rotor unbalance resulting therefrom.

A first primary separation stage (working under the action of the terrestrial gravity) is therefore used more generally upstream from a gas compressor for rough separation of the gas and the liquid, then a second, secondary (for example sieve) separation stage is used for finer separation of the droplets contained in the gas. This layout also requires a single-phase pump for transfer of the liquid from the input pressure to the discharge pressure. These equipments are heavy and bulky.

The volume of the static separators can be reduced while maintaining the same degree of separation of the liquid droplets and of the gas, by generating great centrifugal forces produced only by using the energy of the fluid (without external energy supply). This is for example the working principle of cyclone separators.

The volume of the separators can be reduced further yet, while maintaining the same degree of separation of the liquid droplets and of the gas, by generating very great centrifugal forces produced from an external energy (separators known as dynamic separators). It is for example the working principle of the dynamic separator described in the Bertin patent No. WO-87/03051. While this separator has the advantage of being relatively compact, it constitutes a second rotating machine when it is mounted outside the compressor, and it reduces the number of impellers of the compressor by about 30% when mounted inside the compressor.

SUMMARY OF THE INVENTION

The object of the invention is a wet gas compression device that overcomes the drawbacks of the prior art.

The present invention relates to a wet gas compression device comprising in combination at least the following elements:

- a compression device suited to compress a gas, said compression device comprising at least one gas delivery line and at least one compressed gas discharge line, and one or more lines allowing withdrawal or reinjection of at least a fraction of the gas circulating in the compressor,

- at least one wet gas delivery line,
- a circuit comprising at least the following elements:
  - a separator separating the liquid phase from the gas phase, said separator being connected to the line,
  - a liquid phase discharge line and a gas phase discharge line,
  - a heat exchanger,
  - the heat exchanger is connected at least to the following lines:
    - a delivery line for the mainly liquid phase,
    - a delivery line for a compressed gas, which can be a line for withdrawing compressed gas from the compressor,
    - a line allowing to send the compressed gas back to a compression stage after heat exchange with the liquid fraction,
    - a discharge line for the liquid fraction vaporized by heat exchange. The liquid fraction can be sent to the compressor or to any other destination.

The device can also comprise several temperature detectors $C_T$ placed for example at the level of the lines.

The rank i of the stage Ei of the compressor equipped with the withdrawal line and/or the line designed to send the gas back to a stage of the compressor is for example determined so as to satisfy the relation:

$$Q_g > Q_{12}$$

with $$Q_{12} = L_1 M_1 + C_1 (T_2 - T_1) M_1 + Cp_{g1} (T_3 - T_2) M_1$$

$$Q_g = Cp_{g2} (T_5 - T_4) M_g$$

and

- $L_1$, $C_1$, $Cp_{g1}$, $Cp_{g2}$, $M_1$, $M_g$, which respectively correspond to the latent heat of the liquid, to the specific heats of the liquid, of the vapour and of the gas, and to the mass flow rates of the liquid and of the gas, and
- $T_1$, $T_3$, $T_4$ and $T_5$ represent the temperatures measured on lines 11, 14, 6 and 5 respectively; $T_2$ represents the evaporation temperature of the liquid at the input pressure of the wet gas.

The device can comprise a pressure control device placed downstream from the separator.

The device according to the invention comprises for example a bypass line allowing to divert part of the main gas flow withdrawn from the compressor before it passes into the heat exchanger, the bypass line being equipped with a gas flow control valve.

The line allowing to send the diverted gas flow back to a compression stage after heat exchange with the liquid fraction can be equipped with a control valve placed downstream from said heat exchanger.

The withdrawal line can be the main compressed gas discharge line and it can divide into two lines. A first line allows discharge of a first compressed gas fraction and a second line allows recycle of a second compressed gas fraction to the compressor, the second line being equipped with a control valve and the second line being connected to the compressor inlet or to the static mixer placed upstream from the compressor inlet, the recycled gas amount being so determined that $Q_g > Q_{12}$.

The withdrawal line is for example the discharge line and it can be divided into two lines. A first line allows discharge of a first compressed gas fraction and a second line allows recycle of a second compressed gas fraction to the compressor, the second line being equipped with a control valve and said second line being connected to a stage of the compressor.

The present invention also relates to a method for compressing a wet gas comprising at least one gas phase and at least one liquid phase.

It is characterized in that it comprises in combination at least the following stages:

(a) a separation stage at the end of which a mainly gas phase and a mainly liquid phase are obtained, (b) a stage of conversion of said mainly liquid phase from separation phase (a) to a vapour phase by heat exchange, (c) a stage of compression of the gas phases from stages (a) and (b).

Conversion stage (b) consists for example in:

(d) withdrawing at least part of the gas phase during a compression stage, (e) sending the mainly liquid phase from the separation stage to a heat exchanger, (f) carrying out the conversion of the mainly liquid phase to vapour by heat exchange with the gas phase withdrawn (stage (d)).

The amount of gas phase withdrawn for stage (f) can be controlled.

All of the gas phase is for example withdrawn at the end of the compression stage, said withdrawn part is used for carrying out stage (f) and part of the gas phase is recycled to a compression stage.

All of the gas phase can also be withdrawn at the end of the compression stage, said withdrawn part is used for carrying out stage (f) and part of the gas phase is recycled before the first compression stage.

The compression device according to the invention will be advantageously used for desiccating a wet gas in petroleum production.

The compression device according to the invention notably has the following advantages:

it requires a single rotating machine instead of two in a conventional production program (single-phase compressor and pump), hence a mechanics simplification and an improvement in the equipment reliability, it is compact and not very bulky, it allows to decrease the power absorbed by the gas for a flow rate Mg on account of the gas temperature decrease at the exchanger outlet. This advantage exists only provided that evaporation of the liquid can be achieved from a gas withdrawn at a lower pressure than the discharge pressure, since the temperature reduction effect only concerns the compression stages situated between the heat exchanger and the compressor discharge end.

the discharge temperature of the compressor is reduced.

In the absence of evaporation of the liquid, the discharge temperature could exceed the maximum temperature allowable by the manufacturer, which requires a heat exchanger and a high external coolant flow rate. The device allows to use an internal coolant and only requires a low flow rate, the quantity of heat transferred mainly corresponding to the latent heat of the liquid.

BRIEF DESCRIPTION OF THE DRAWINGS

Other features and advantages of the device according to the invention will be clear from reading the description hereafter of a non limitative embodiment example, with reference to the accompanying drawings wherein.

DETAILED DESCRIPTION OF THE INVENTION

Figure 1:
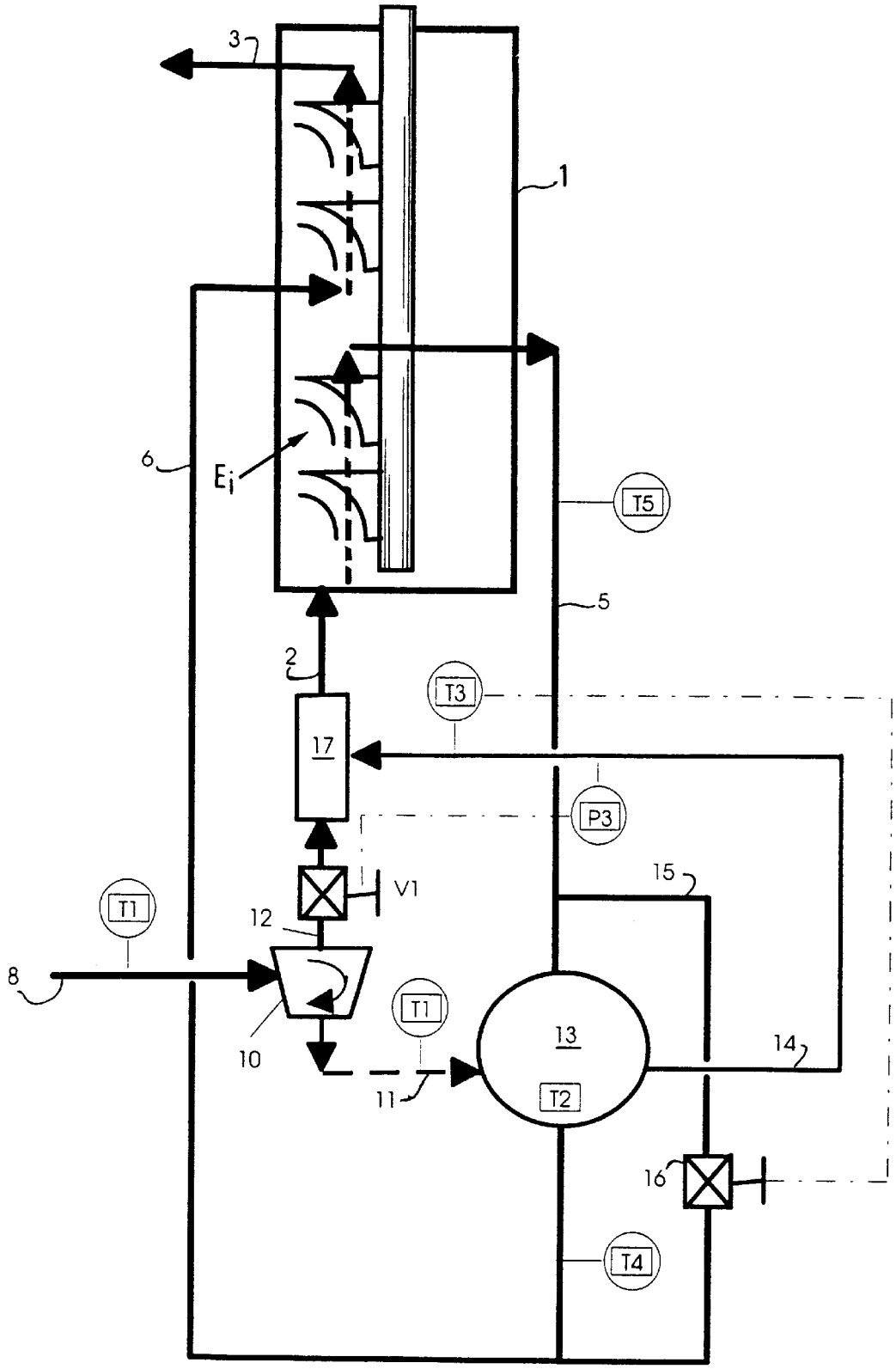
FIG. 1 diagrammatically shows an example of wet gas compression device according to the invention where all of the compressed gas is withdrawn, FIG. 2 schematizes a variant of the system where only a fraction of the gas is withdrawn, and FIGS. 3 and 4 schematize two variants of the wet gas compressor of FIG. 1 with withdrawal of the gas at the compressor outlet and recycle of part of this gas.

The wet gas compression device described in FIG. 1 comprises a compressor 1 mainly suited for compression of a dry gas (i.e. a gas containing liquid droplets of a diameter below 10 microns).

Compressor 1 is for example an axial compressor or a radial compressor comprising impellers commonly used by specialists in the technical sphere concerned.

It comprises at least one gas suction line 2 and at least one compressed gas discharge line 3.

At least two additional lines, referred to as intermediate lines, can be positioned between the inlet stage $E_e$ and the outlet stage $E_s$ of the compressor. These lines are respectively used for extraction of all the gas circulating in the compressor, then reintroduction in the compressor downstream from the point of extraction after passage in a heat exchanger for evaporation of the liquid phase contained in the wet gas.

Line 5 extracts the gas immediately downstream from the impeller of rank i of compression stage $E_i$, whereas line 6 reintroduces the gas immediately upstream from the impeller of rank i+1 corresponding to compression stage $E_{i+1}$.

The wet gas is fed into the wet gas compression device through a line 8.

Without departing from the scope of the invention, it is possible to distribute several withdrawal and reinjection lines at various compression levels, the lines being similar to lines 5 and 6 as regards their function and design.

Associated with the compressor, the wet gas compression device according to the invention comprises an array of equipments designed for separation and evaporation of the liquid fraction contained in the wet gas. These various elements notably comprise:

a separator 10, for example a cyclone separator, separating the liquid phase from the gas phase, supplied with wet gas by delivery line 8, a liquid phase discharge line 11 and a a gas phase discharge line 12, a valve $V_1$ for controlling the pressure, this valve being placed downstream from the separator, for example on line 12, line 12 being connected to line 2 for gas delivery to the compressor, a heat exchanger 13 comprising for example, in the cold part, the liquid to be evaporated from the separation stage and, in the hot part, the gas from the compression stage, heat exchanger 13 is connected at least to the following lines:

liquid phase delivery line 11, gas circulation line 5, line 6 allowing the main gas flow to be sent back to a compression stage after heat exchange with the liquid fraction, a line 14 for discharge of the liquid fraction vaporized after heat exchange to the compressor or to any other destination, several temperature detectors $C_T$ placed for example at the level of lines 5, 8, 11, 6 and 14. These detectors notably allow to control overheating of the vaporized gas and cooling of the compressed gas.

In combination with these equipments and in order to improve operation of the wet gas compression device according to the invention, it is also possible to associate at least one of the following elements:

- a bypass line 15 for diverting part of the gas flow withdrawn from the compressor by means of line 5. This bypass line is for example equipped with a flow control valve 16. The opening or closing degree of this valve 16 is adjusted so as to allow evaporation of the liquid, and to obtain a slight overheating of the vapour coming from the exchanger so as to reduce to the minimum the size of the droplets at the inlet of the compressor,
- a mixer 17, for example a static type mixer, placed downstream from pressure control valve $V_1$.

This mixer notably allows mixing of the gas phase coming from the cyclone separator, which contains very fine droplets, with the overheated vapour coming from the exchanger.

The very fine droplets contained in the vapour phase at the outlet of the exchanger are converted to vapour as a result of overheating.

The main gas flow withdrawn from a compression stage is used in the wet gas compression device according to the invention as an agent allowing evaporation of the liquid initially contained in a wet gas.

The number i of the compression stage from which the main gas flow is withdrawn can for example be fixed as follows:

- the nature of the wet gas and the composition thereof are taken into account,
- parameters $L_1$, $C_1$, $Cp_{g1}$, $Cp_{g2}$, $M_1$, $M_g$, respectively corresponding to the latent heat of the liquid, the specific heats of the liquid, of the vapour and of the gas, and to the mass flow rates of the liquid and of the gas (main flow in the compressor), are known,
- the quantity of heat to be supplied to the liquid in order to allow evaporation thereof is first determined by a first equation:

$$Q_{11}=L_1M_1+C_1(T_2-T_1)M_1 \quad (1)$$

where $T_1$ is the temperature of the liquid at the inlet of the compression device, and $T_2$ the evaporation temperature of the liquid (at the input pressure), which can be determined from the composition of the liquid,

- in order to keep a certain safety margin, the quantity of heat to be supplied is defined by the following equation:

$$Q_{12}=L_1M_1+C_1(T_2-T_1)M_1+Cp_{g1}(T_3-T_2)M_1 \quad (2)$$

where $T_3$ is a set temperature corresponding to the desired overheating of the vapour,

- the quantity of heat supplied by the gas in the heat exchanger is determined from equation (3):

$$Q_gCp_{g2}(T_5-T_4)M_g \quad (3)$$

where $T_4$ and $T_5$ are the temperature values of the gas respectively at the outlet of heat exchanger 13 and at the outlet of the compressor, for example at the level of line 5. The difference between temperatures $T_4$ and $T_1$ is determined by the geometric characteristics of the exchanger, for example by implementing calculations or methods known to the man skilled in the art.

The number i of the compressor stage preceding the intermediate outlet of the gas withdrawn is determined so as to satisfy relation (4):

$$Q_g>Q_{12} \quad (4).$$

The gas withdrawal line 5 used at the level of heat exchanger 13 is placed just downstream from the volute situated after compression stage $E_i$. The volute is defined as the gas inlet or outlet adapter part conventionally used in compressors.

Line 6, which allows reintroduction of the gas after it has served as a liquid vaporization agent at the level of the exchanger, is placed upstream from the volute preceding compression stage $E_{i+1}$.

This procedure allows to obtain a sufficient vapour overheating degree allowing elimination of the liquid droplets with a greater diameter than the diameter likely to involve erosion risks. Concerning the degree of overheating, the temperature rise will preferably be of the order of 5 K in relation to the evaporation temperature of the liquid.

Figure 2:
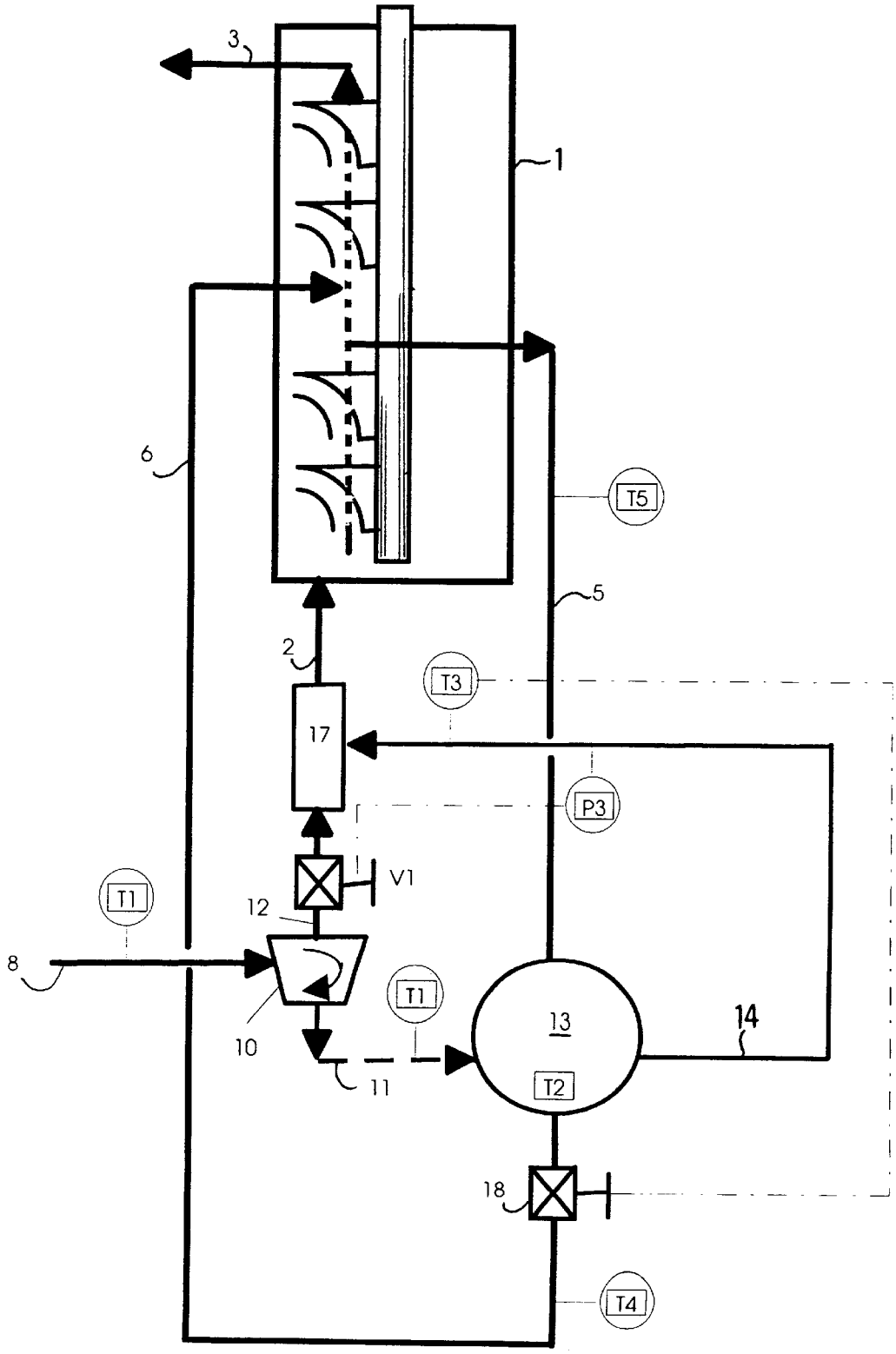

According to another embodiment, FIG. 2 shows a wet gas compression device where only a fraction of the main gas flow circulating in the compressor is withdrawn.

In relation to FIG. 1, the wet gas compression device comprises no external bypass line.

A fraction of the main gas flow circulating in the compressor is withdrawn through line 5 downstream from compression stage $E_i$, sent to the heat exchanger for evaporation of the liquid, then through line 6 to the compressor where it is reintroduced upstream from compression stage $E_{i+1}$. Line 6 is provided with a recycle valve 18 for control of the gas flow rate.

When the direction of the inequality between the heat quantity values is observed only at the outlet of the last stage, the compressor may not comprise intermediate gas withdrawal lines between the inlet stage $E_e$ of the compressor and outlet stage $E_s$.

Such an embodiment notably has the advantage of receiving the maximum heat the gas can have by withdrawing it at the compressor outlet.

When relation (4) cannot be verified even at the compressor outlet, a means of vaporizing all of the liquid with a sufficient overheating margin consists in recycling part of the gas coming from the compressor. Two recycle instances are shown in FIGS. 3 and 4.

Figure 3:
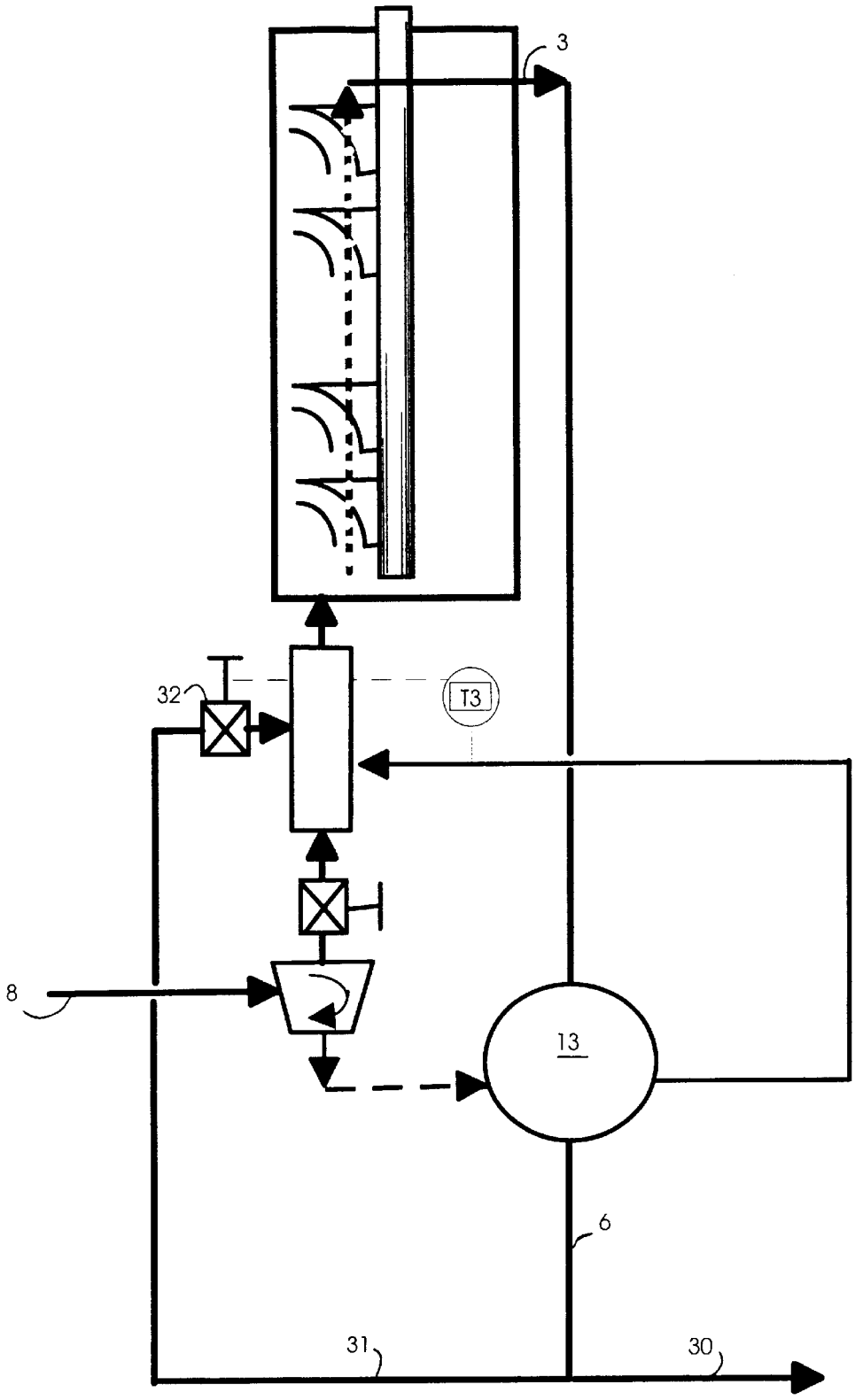
Figure 4:
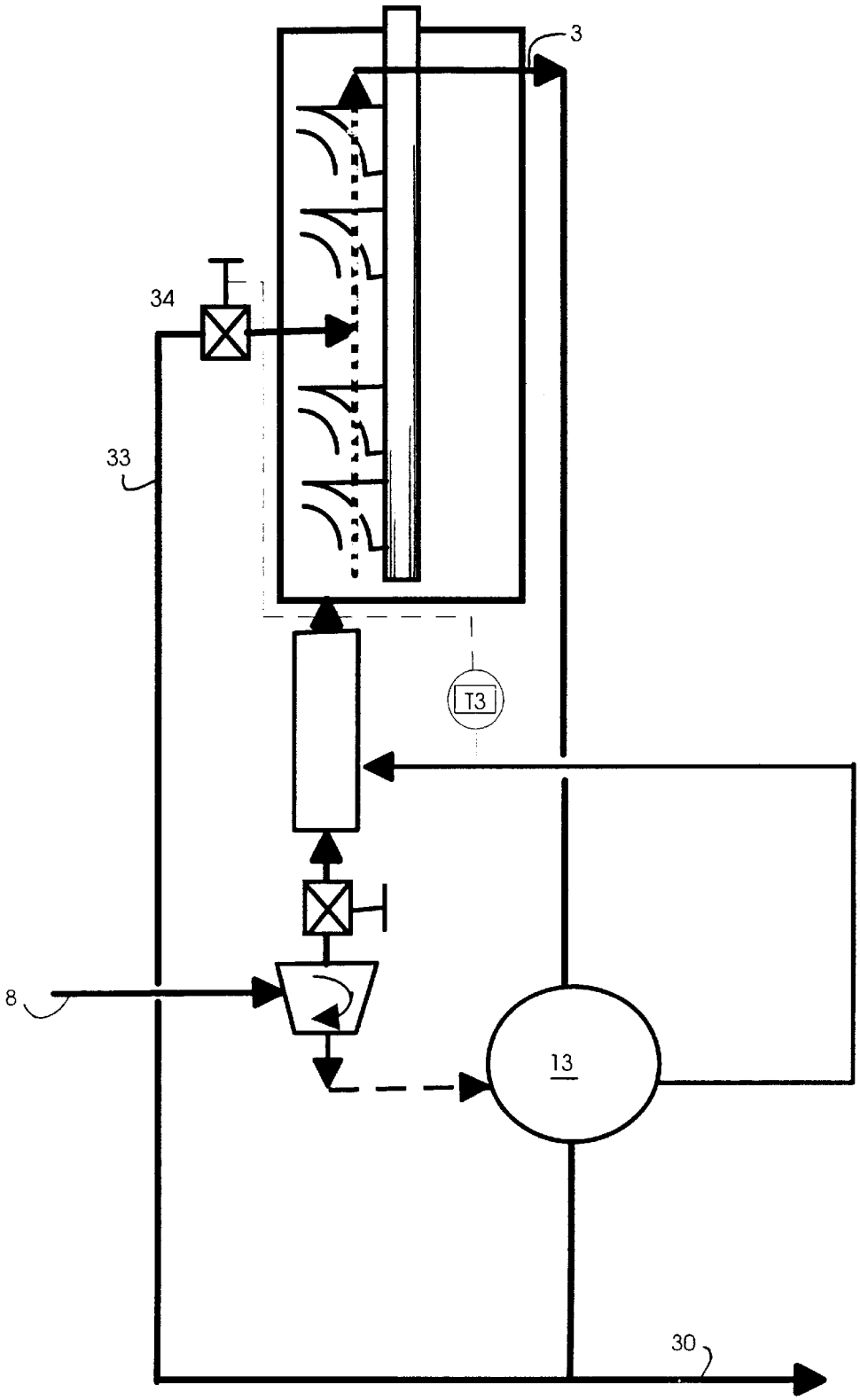

FIG. 3 schematizes an example of a wet gas compression device suited to cases where the discharge temperature $T_r$ of the compressor is lower than the maximum temperature $T_{max}$ allowable by the compressor.

In this situation, it is possible to increase the quantity of heat that can be released by the compressed gas withdrawn and used as a vaporization agent. All of the compressed gas flow coming from the last compression stage is therefore sent through line 3 to heat exchanger 13. At the outlet of this heat exchanger, line 6 divides into two sublines 30, 31.

A first gas fraction is discharged through line 30 to a point of destination, whereas a second gas fraction is recycled to compressor 1 through line 31.

The recycled fraction is for example introduced at the level of static mixer 17 where it is mixed with the vapour coming from the heat exchanger and the gas coming from the cyclone separator.

Line 31 is provided with a recycling valve 32 allowing to control the flow rate of the recycled gas fraction.

The heat increase of the gas is proportional to the gas fraction recycled.

FIG. 4 shows another variant that is suitable when the discharge temperature $T_r$ of the compressor is higher than temperature $T_{max}$, the compressor working without recycle.

In this situation, it is possible to reduce the discharge temperature of the compressor while increasing the quantity of heat that can be released by the gas by recycling a fraction of the outgoing gas only to the last compression stages.

The compression device differs from that described in FIG. 3 in the position difference of the gas recycling line in relation to the compressor.

In this case, line 33 designed for recycle of the second gas fraction is connected downstream from compression stage En. The recycling line is equipped with a valve 34 allowing control of the gas flow rate.

The increase in the heat released by the gas then depends on the gas fraction recycled and on the ratio of the manometric heads corresponding respectively to the impellers of the compressor through which the recycled gas flows and all the impellers forming the compressor.

The rank n of compression stage En is selected so as to minimize the power increase due to the gas recycle while allowing evaporation of the liquid with the required overheating margin and maintaining the discharge temperature at a lower level than $T_{max}$.

The advantages of the device consisting of a compressor with upstream separation/evaporation of the liquid in relation to single-phase machine production are as follows:

use of a single rotating machine instead of two, decrease of the power absorbed by the gas for a flow rate Mg due to the gas temperature decrease at the exchanger outlet. This advantage only exists providing that evaporation of the liquid can be performed from a gas withdrawn at a lower pressure than the discharge pressure, since the temperature reduction effect only concerns the compression stages situated between the heat exchanger and the compressor discharge end, reduction of the discharge temperature of the compressor. In the absence of evaporation of the liquid, the discharge temperature could exceed the maximum temperature allowable by the manufacturer requiring a heat exchanger and a high flow rate of the external coolant. The device allows to use an internal coolant and requires only a low flow rate, the quantity of heat transferred mainly corresponding to the latent heat of the liquid.

Numerical example of power decrease by evaporation of the liquid phase and without recompression of the evaporated gas phase:

Case of a compressor with two sections absorbing each a power of 2 MW, without intermediate cooling system, With evaporation of the liquid phase, the temperature of the gas at the inlet of the second section is reduced from 400 to 300 K and, consequently, the manometric head and the absorbed power (from 2 to 1.5 MW) is reduced by 25%. The power is reduced by 12.5% for the whole of the compressor.

The advantages of the device consisting of a compressor with upstream separation/evaporation of the liquid in relation to rotodynamic multiphase machine production are as follows:

use of a single rotating machine instead of several, the number of multiphase machines varying mainly with the GLR and the input pressure, as shown in the tables below, compression efficiency improvement, the efficiency of single-phase impellers being much higher than that of two-phase impellers.

The data given in the two tables hereunder illustrate the advantages of the compressor with separation/compression according to the invention.

Comparison basis:

molecular mass of the gas=25 output pressure/input pressure ratio=3 input temperature=313 K.

On the basis of these data, the compressor with integrated separation/compression would comprise 6 impellers.

The tables hereunder give the number of impellers and the number of machines required by a multiphase pumping system.

Case GLR=40

| Suction pressure-Mpa abs | 1 | 2 | 3 | 4 |
|---|---|---|---|---|
| Number of impellers | 43 | 50 | 54 | 57 |
| Number of pumps | 3 | 4 | 4 | 4 |

Case GLR=100

| Suction pressure-Mpa abs | 1 | 2 | 3 | 4 |
|---|---|---|---|---|
| Number of impellers | 57 | 64 | 66 | 68 |
| Number of pumps | 4 | 5 | 5 | 5 |

These tables show that the number of multiphase pumps increases with both the GLR and the suction pressure, the reference device consisting only of a single gas compressor and of a single heat exchanger in the previous example.

The device can advantageously be used for desiccating a wet gas:

in the field of petroleum production, in the field of refining and chemistry in order to eliminate the droplet separating device commonly used upstream from the compressor, in any field using a droplet separating device whose purpose is to hold back the droplets.

What is claimed is:

1. A method designed for compression of a wet gas, comprising the following steps:

(a) separating said wet gas into a stream mainly comprising a gas phase and a stream mainly comprising a liquid phase;

(b) carrying out heat exchange of said stream mainly comprising said liquid phase from step (a) to convert said liquid phase a vapour phase; and (c) compressing said stream mainly comprising said gas phase from step (a) and said vapour phase from step (b).

2. A method as claimed in claim 1, wherein step (b) comprises the steps of:

(d) withdrawing at least part of the gas phase during a compression stage in step (c);

(e) sending the stream mainly comprising said liquid phase from step (a) to a heat exchanger; and (f) carrying out the conversion of the stream mainly comprising said liquid phase to said vapour phase by heat exchange with the at least part of the gas phase withdrawn in step (d).

3. A method as claimed in claim 1, characterized in that the amount of gas phase withdrawn for stage (f) is controlled.

4. A method as claimed in any one of claims 1 or 2, characterized in that in step (d) all of the gas phase is withdrawn at the an outlet of the compression stage in step (c), said withdrawn part is used for carrying out step (f) and at least a part of the gas phase is recycled to a compression stage.

5. A method as claimed in any one of claims 1 or 2, characterized in that in step (d) all of the gas phase is withdrawn at an outlet of the compression stage in step (c), said withdrawn part is used for carrying out step (f) and at least a part of the gas phase is recycled before a first compression stage.

6. A method as claimed in any one of claims 1 or 2, wherein the wet gas is a wet gas in petroleum production.

* * * * *